US011257416B2

(12) United States Patent
Jose et al.

(10) Patent No.: US 11,257,416 B2
(45) Date of Patent: Feb. 22, 2022

(54) VOLTAGE MODE PRE-EMPHASIS WITH FLOATING PHASE

(71) Applicant: Samsung Display Co., Ltd., Yongin-si (KR)

(72) Inventors: Anup P. Jose, San Jose, CA (US); Younghoon Song, Santa Clara, CA (US)

(73) Assignee: Samsung Display Co., Ltd., Yongin-si (KR)

( * ) Notice: Subject to any disclaimer, the term of this patent is extended or adjusted under 35 U.S.C. 154(b) by 0 days.

(21) Appl. No.: 16/848,706

(22) Filed: Apr. 14, 2020

(65) Prior Publication Data

US 2021/0256897 A1 Aug. 19, 2021

Related U.S. Application Data

(60) Provisional application No. 62/977,094, filed on Feb. 14, 2020.

(51) Int. Cl.
*G09G 3/20* (2006.01)

(52) U.S. Cl.
CPC ... *G09G 3/2018* (2013.01); *G09G 2300/0842* (2013.01); *G09G 2320/0252* (2013.01)

(58) Field of Classification Search
CPC ..... G09G 3/2018; G09G 2300/0842; G09G 2320/0252
See application file for complete search history.

(56) References Cited

U.S. PATENT DOCUMENTS

| | | | |
|---|---|---|---|
| 5,239,210 | A | 8/1993 | Scott |
| 6,320,565 | B1 | 11/2001 | Albu et al. |
| 6,753,913 | B1 | 6/2004 | Bilhan et al. |
| 6,822,679 | B1 | 11/2004 | Kulhalli et al. |
| 6,909,391 | B2 | 6/2005 | Rossi |
| 6,919,551 | B2 | 7/2005 | Barna et al. |
| 7,245,321 | B2 | 7/2007 | Panicacci et al. |
| 7,764,118 | B2 | 7/2010 | Kusuda et al. |

(Continued)

FOREIGN PATENT DOCUMENTS

| | | |
|---|---|---|
| EP | 0 986 900 B1 | 8/2005 |
| EP | 2 738 757 A1 | 6/2014 |

(Continued)

OTHER PUBLICATIONS

U.S. Appl. No. 16/656,423, filed Nov. 6, 2019.

(Continued)

*Primary Examiner* — Towfiq Elahi
(74) *Attorney, Agent, or Firm* — Lewis Roca Rothgerber Christie LLP

(57) ABSTRACT

A circuit. In some embodiments, the circuit includes: a drive circuit having an output and including: a pre-emphasis circuit; and an output stage connected to an output of the pre-emphasis circuit. The pre-emphasis circuit may be configured to generate, during a first interval of time, a pre-emphasized signal. The output stage may be configured to produce, at the output of the drive circuit, a constant signal based on the pre-emphasized signal during the first interval of time, and to disconnect the pre-emphasis circuit from the output of the drive circuit during a second interval of time, the second interval of time beginning at the end of the first interval of time.

20 Claims, 5 Drawing Sheets

(56) References Cited

U.S. PATENT DOCUMENTS 8,497,731 B1 7/2013 Beckwith et al.
8,659,325 B2 * 2/2014 Nishi ..... H04L 25/0286 327/108
9,191,598 B2 11/2015 Blanquart et al.
9,721,504 B2 8/2017 Kim et al.
9,722,582 B2 * 8/2017 Jung ..... H03K 17/16
10,714,051 B1 * 7/2020 Huang ..... G09G 5/008
10,762,836 B1 9/2020 Bae et al.
2005/0243193 A1 11/2005 Gove et al.
2005/0248671 A1 11/2005 Schweng
2006/0139097 A1 * 6/2006 Mukherjee ..... H03F 3/4521 330/257
2006/0238477 A1 10/2006 Lew et al.
2007/0030262 A1 2/2007 Ambo et al.
2007/0080908 A1 4/2007 Nathan et al.
2009/0058324 A1 3/2009 Nakao
2009/0237121 A1 9/2009 Surendranath et al.
2009/0295422 A1 12/2009 Hamer et al.
2010/0271517 A1 10/2010 De Wit et al.
2013/0082936 A1 4/2013 Islamkulov et al.
2013/0099692 A1 4/2013 Chaji et al.
2013/0100173 A1 4/2013 Chaji et al.
2013/0141368 A1 * 6/2013 Wang ..... G06F 3/044 345/173
2014/0152642 A1 6/2014 Kim et al.
2014/0198092 A1 7/2014 Azizi et al.
2015/0009204 A1 1/2015 Chaji
2015/0195569 A1 7/2015 Jung et al.
2015/0213757 A1 7/2015 Takahama et al.
2015/0243221 A1 * 8/2015 Lim ..... G09G 3/3258 345/76
2015/0261341 A1 * 9/2015 Weinerth ..... G06F 3/0446 345/174
2016/0005358 A1 1/2016 Wang
2016/0012765 A1 1/2016 Jeong
2016/0055791 A1 * 2/2016 Kishi ..... G09G 3/30 345/212
2016/0086539 A1 3/2016 Mizukoshi
2016/0202061 A1 7/2016 Maurer et al.
2016/0261817 A1 9/2016 Totsuka et al.
2016/0267844 A1 9/2016 Senda et al.
2016/0372044 A1 12/2016 Kwon et al.
2017/0003779 A1 1/2017 Reynolds et al.
2017/0039939 A1 2/2017 Chaji
2017/0039953 A1 2/2017 Lee
2017/0090669 A1 3/2017 Paladugu et al.
2017/0093421 A1 3/2017 Bell et al.
2017/0154573 A1 6/2017 Woo et al.
2018/0090042 A1 3/2018 Lin et al.
2018/0100943 A1 * 4/2018 Sternberg ..... G01V 3/104
2018/0114815 A1 4/2018 Lee et al.
2018/0166515 A1 6/2018 An et al.
2018/0182303 A1 6/2018 Jung et al.
2018/0336816 A1 * 11/2018 Shin ..... G09G 3/3688
2019/0035351 A1 1/2019 Pyun et al.
2019/0088205 A1 3/2019 Zhang et al.
2019/0221146 A1 7/2019 Lin et al.
2019/0247664 A1 8/2019 Irazoqui et al.
2019/0336757 A1 11/2019 Rodriguez et al.
2020/0091884 A1 3/2020 Venkatraman et al.
2020/0184888 A1 6/2020 Brownlow et al.
2020/0202787 A1 6/2020 Do et al.

FOREIGN PATENT DOCUMENTS

EP 3 343 556 A1 7/2018
KR 10-2008-0107064 A 12/2008
KR 10-2013-0053458 A 5/2013

OTHER PUBLICATIONS

U.S. Appl. No. 16/656,447, filed Oct. 17, 2019.
U.S. Appl. No. 16/657,680, filed Oct. 18, 2019.
U.S. Notice of Allowance dated Dec. 11, 2020, issued in U.S. Appl. No. 16/656,447 (10 pages).
U.S. Office Action dated Jan. 28, 2021, issued in U.S. Appl. No. 16/869,546 (10 pages).
Extended European Search Report for corresponding European Patent Application No. 20156633.8, dated Apr. 16, 2020, 9 pages.
U.S. Notice of Allowance dated Sep. 9, 2020, issued in U.S. Appl. No. 16/657,680 (8 pages).
U.S. Office Action dated Aug. 7, 2020, issued in U.S. Appl. No. 16/656,447 (26 pages).
Chen, Hsin-Liang, et al.; A Low-Offset Low-Noise Sigma-Delta Modulator With Pseudorandom Chopper-Stabilization Technique, IEEE Transactions on Circuits and Systems—I: Regular Papers, vol. 56, No. 12, Dec. 2009, 11 pages.
Extended European Search Report for corresponding European Patent Application No. 20179974.9, dated Aug. 20, 2020, 12 pages.
Extended European Search Report for corresponding European Patent Application No. 20176949.4, dated Aug. 27, 2020, 13 pages.
U.S. Notice of Allowance dated Jun. 1, 2021, issued in U.S. Appl. No. 16/656,423 (13 pages).

* cited by examiner

VOLTAGE MODE PRE-EMPHASIS WITH FLOATING PHASE

CROSS-REFERENCE TO RELATED APPLICATION(S)

The present application claims priority to and the benefit of U.S. Provisional Application No. 62/977,094, filed Feb. 14, 2020, entitled "VOLTAGE MODE PRE-EMPHASIS WITH FLOATING PHASE", the entire content of which is incorporated herein by reference.

The present application is related to U.S. patent application Ser. No. 16/656,447, filed Oct. 17, 2019, entitled "FULLY DIFFERENTIAL FRONT END FOR SENSING", (the "'447 Application"), and to U.S. patent application Ser. No. 16/656,423, filed Oct. 17, 2019, entitled "CORRELATED DOUBLE SAMPLING PIXEL SENSING FRONT END" (the "'423 Application"), and to U.S. patent application Ser. No. 16/657,680, filed Oct. 18, 2019, entitled "ESTIMATION OF PIXEL COMPENSATION COEFFICIENTS BY ADAPTATION" (the "'680 Application"). The entire contents of all of the applications identified in this paragraph are incorporated herein by reference.

FIELD

One or more aspects of embodiments according to the present disclosure relate to displays, and more particularly to a system and method for driving a pixel in a display.

BACKGROUND

In a digital display, the transmitting circuit (e.g., the conductor) that connects a drive circuit to a pixel in the display may have significant series resistance, and significant capacitance to ground. This may result in slowing of the drive signal, potentially to an extent that cannot be tolerated in a display having a large number of pixels and operating at a high frame rate.

Thus, there is a need for an improved system and method for driving a pixel in a display.

SUMMARY

According to an embodiment of the present invention, there is provided a circuit, including: a drive circuit having an output and including: a pre-emphasis circuit; and an output stage connected to an output of the pre-emphasis circuit, the pre-emphasis circuit being configured to generate, during a first interval of time, a pre-emphasized signal, the output stage being configured to produce, at the output of the drive circuit, a constant signal based on the pre-emphasized signal during the first interval of time, and to disconnect the pre-emphasis circuit from the output of the drive circuit during a second interval of time, the second interval of time beginning at the end of the first interval of time.

In some embodiments, the circuit further includes: a driven circuit, and a transmitting circuit, connecting the output of the drive circuit to the driven circuit, the transmitting circuit including a circuit equivalent to a resistor-capacitor low-pass circuit.

In some embodiments, the driven circuit includes a pixel circuit for a pixel of a display.

In some embodiments, the transmitting circuit is connected to a gate of a thin-film drive transistor of the pixel circuit.

In some embodiments, the output stage includes an amplifier stage configured, in a first state, to produce an output voltage and, in a second state, to have an output impedance greater than 100 ohms.

In some embodiments, the amplifier stage includes: a differential pair; and a tail current source connected to the differential pair, wherein, in the second state, the tail current source is shut off.

In some embodiments, the tail current source is an n-channel metal oxide transistor, and, in the second state, a gate of the tail current source is connected to ground.

In some embodiments, the output stage includes a plurality of differential pairs, and a corresponding plurality of tail current sources, each connected to a respective one of the differential pairs, wherein, in the second state, each of the tail current sources is shut off.

In some embodiments, the circuit further includes a sensing and control circuit configured to sense a drive current driven by the thin-film drive transistor, and to control the pre-emphasized signal based on a difference between the sensed drive current and a target drive current.

In some embodiments, the output stage includes an amplifier stage configured, in a first state, to produce an output voltage and, in a second state, to have an output impedance greater than 100 ohms.

In some embodiments, the amplifier stage includes: a differential pair; and a tail current source connected to the differential pair, wherein, in the second state, the tail current source is shut off.

In some embodiments, the tail current source is an n-channel metal oxide transistor, and, in the second state, a gate of the tail current source is connected to ground.

In some embodiments, the output stage includes a plurality of differential pairs, and a corresponding plurality of tail current sources, each connected to a respective one of the differential pairs, wherein, in the second state, each of the tail current sources is shut off.

In some embodiments, the driven circuit includes a pixel circuit for a pixel of a display.

In some embodiments, the drive circuit is connected to a gate of a thin-film drive transistor of the pixel circuit.

In some embodiments, the circuit further includes a sensing and control circuit configured: to sense: a drive current driven by the thin-film drive transistor, or a voltage at the output of the drive circuit during the second interval of time; and to control the pre-emphasized signal based on: a difference between the sensed drive current and a target drive current, or a difference between the sensed voltage and a target voltage.

According to an embodiment of the present invention, there is provided a method for driving a pixel in a display, the method including: during a first interval of time, generating, by a drive circuit having an output, a first constant pre-emphasized output voltage; and during a second interval of time, beginning at the end of the first interval of time, causing the drive circuit to have a high output impedance at the output of the drive circuit.

In some embodiments, the method further includes including sensing a drive current driven by a thin-film drive transistor of a pixel circuit of a display, and during a third interval of time following the second interval of time, generating, by the drive circuit, a second constant pre-emphasized output voltage, the second constant pre-emphasized output voltage being based on the sensed a drive current.

In some embodiments, the method includes, at the end of the first interval of time, switching off a transistor connected to the output of the drive circuit.

According to an embodiment of the present invention, there is provided a display, including: a pixel circuit, a drive circuit having an output connected to the pixel circuit; and means for sensing and control, the drive circuit including: a pre-emphasis circuit; and an output stage connected to an output of the pre-emphasis circuit, the pre-emphasis circuit being configured to generate, during a first interval of time, a pre-emphasized signal, the output stage being configured: to produce, at the output of the drive circuit, a constant signal based on the pre-emphasized signal during the first interval of time, and to disconnect the pre-emphasis circuit from the output of the drive circuit during a second interval of time, the second interval of time beginning at the end of the first interval of time, the means for sensing and control being configured: to sense a drive current driven by a thin-film drive transistor of the pixel circuit, and to control the pre-emphasized signal based on a difference between the sensed drive current and a target drive current.

BRIEF DESCRIPTION OF THE DRAWINGS

These and other features and advantages of the present disclosure will be appreciated and understood with reference to the specification, claims, and appended drawings wherein:

DETAILED DESCRIPTION

The detailed description set forth below in connection with the appended drawings is intended as a description of exemplary embodiments of a system and method for driving a pixel provided in accordance with the present disclosure and is not intended to represent the only forms in which the present disclosure may be constructed or utilized. The description sets forth the features of the present disclosure in connection with the illustrated embodiments. It is to be understood, however, that the same or equivalent functions and structures may be accomplished by different embodiments that are also intended to be encompassed within the scope of the disclosure. As denoted elsewhere herein, like element numbers are intended to indicate like elements or features.

Figure 1:
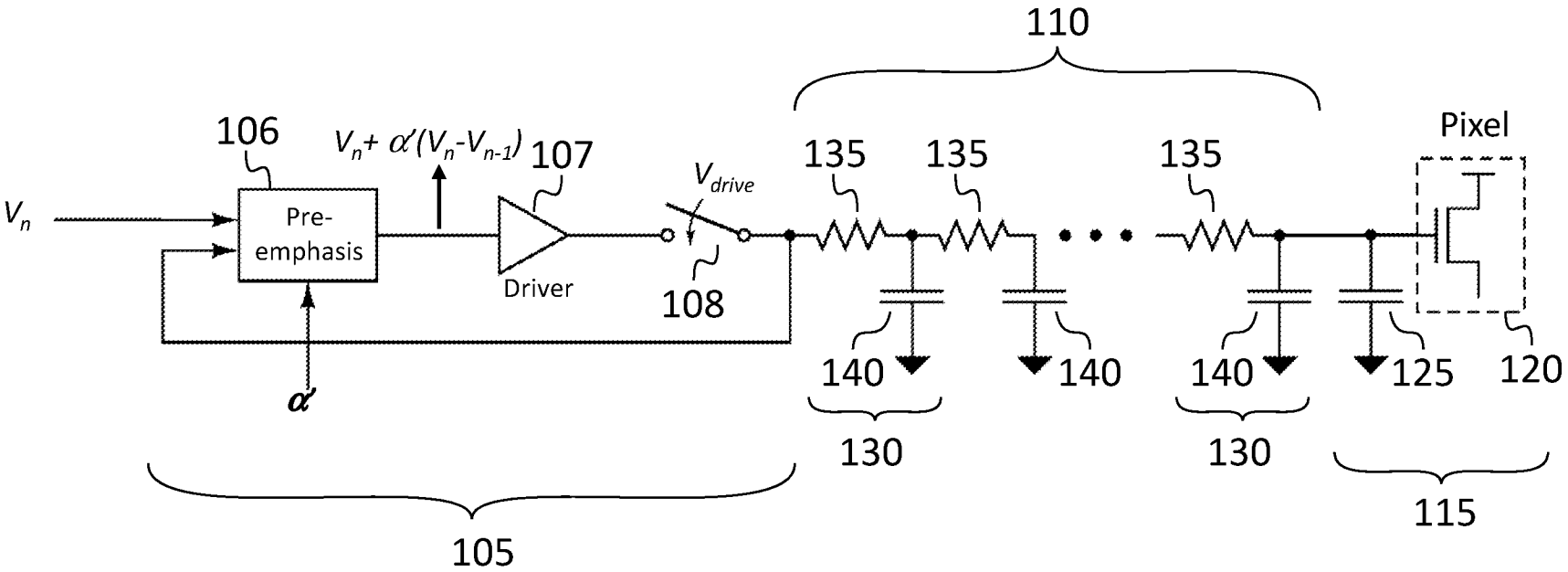
FIG. 1 is a block diagram of a circuit for driving a pixel, according to an embodiment of the present disclosure.

Referring to FIG. 1, in some embodiments a circuit for driving a pixel in a display includes a drive circuit 105, a transmitting circuit (or "channel") 110, and a driven circuit, which may be a pixel circuit 115. The pixel circuit may include a light-emitting element (e.g., a light-emitting diode), a thin-film drive transistor 120 for driving a current through the light-emitting element, and a pixel capacitor 125, for storing a charge and applying a corresponding voltage to the gate of the thin-film drive transistor 120. In FIG. 1, the pixel capacitor 125 is shown as having one terminal connected to ground; in some embodiments, it is connected otherwise, e.g., with one terminal connected (e.g., through another transistor) to the source of the thin-film drive transistor 120. In some embodiments the pixel capacitor is not a separate lumped element as shown but is instead the gate capacitance of the thin-film drive transistor 120 or part of the capacitance of the transmitting circuit 110 (discussed in further detail below), or a combination thereof. The drive circuit 105 may include a pre-emphasis circuit 106, a driver circuit 107 and a switch 108. The transmitting circuit has a first end (or "near end") connected to the output of the drive circuit 105 and a second end (or "far end") connected to the pixel circuit 115.

In operation, the amount of light emitted by the light-emitting element may periodically be changed, e.g., each time the display displays a new frame of video. To effect such a change, a new voltage may be applied to the pixel capacitor 125, by the drive circuit 105, through the transmitting circuit 110, during an interval of time that may be referred to as the programming interval (which is employed to "program" the pixel capacitor with the new voltage). Once the pixel capacitor 125 has been charged to the desired voltage, the transmitting circuit 110 may be disconnected from the pixel circuit 115 (by transistors referred to as "scan transistors" (not shown)) and the drive circuit 105 and the transmitting circuit 110 may then be employed to program the capacitor of another (e.g., neighboring) pixel circuit.

The transmitting circuit 110 may be constructed as a relatively long conductive trace in the display, the trace having a finite resistance per unit length and a finite capacitance, e.g., to ground, per unit length. As such, the transmitting circuit 110 may be considered to consist of an equivalent circuit including a network including (e.g., comprising) a cascade of multiple resistor-capacitor low-pass circuits 130, each including a series resistor 135 and a shunt capacitor 140. Several of these resistor-capacitor low-pass circuits 130 are explicitly drawn in FIG. 1; the equivalent circuit may include a large number of such resistor-capacitor low-pass circuits some of which are not explicitly drawn and are instead represented by the ellipsis " . . . ". The transmitting circuit 110 may have the characteristics of a low-pass filter, so that a rapid change in the voltage at the output of the drive circuit 105 may result in only a slow change in the voltage on the pixel capacitor 125.

Figure 2A:
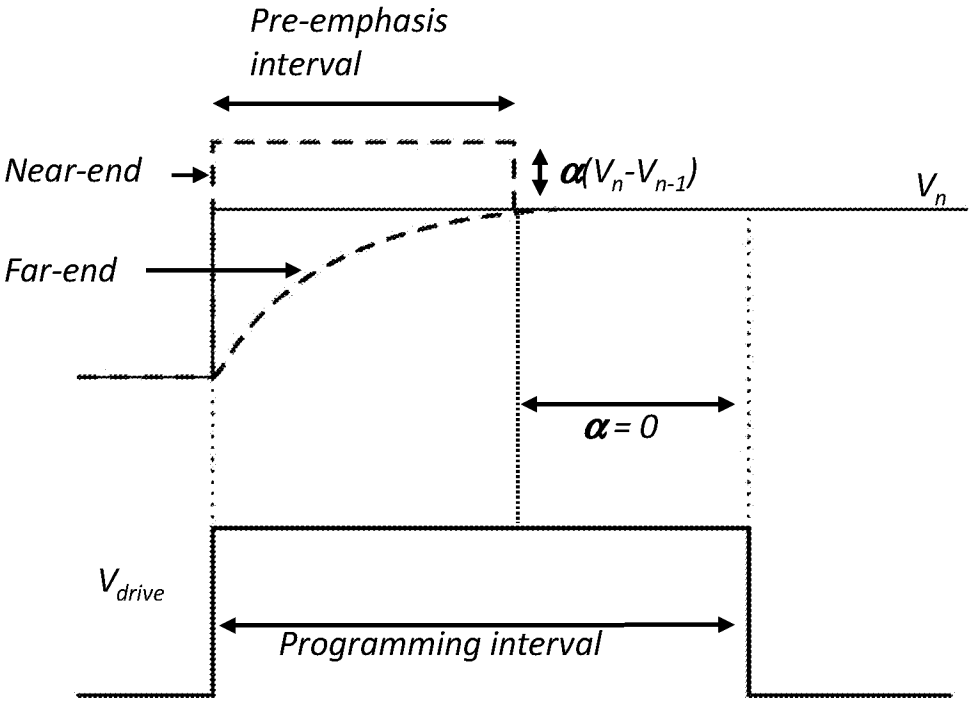
FIG. 2A is a drive waveform diagram, according to an embodiment of the present disclosure.

To compensate for the delay introduced by the transmitting circuit 110, pre-emphasis is employed, in some embodiments. As shown, in FIG. 2A, the output voltage of the drive circuit 105 is initially set to a larger voltage than the voltage $V_n$ with which the pixel capacitor 125 is to be programmed (which may be referred to as the "target voltage"). The output voltage may initially be set to $V_n+\alpha(V_n-V_{n-1})$, where $V_{n-1}$ is the voltage with which the pixel capacitor 125 was programmed during the previous programming interval, and a may be referred to as the pre-emphasis factor. The larger voltage $(V_n+\alpha(V_n-V_{n-1}))$ is applied during an interval referred to as the pre-emphasis interval. During the pre-emphasis interval, the voltage on the pixel capacitor 125 changes more rapidly than it would in the absence of pre-emphasis; as such, the pre-emphasis compensates for, or mitigates, the low-pass filtering effect of the transmitting circuit 110. At the end of the pre-emphasis interval, the output voltage of the drive circuit 105 may be set to $V_n$. The pre-emphasis factor $\alpha$ and the pre-emphasis interval may be selected such that at the end of the pre-emphasis interval, the voltage on the pixel capacitor 125 is sufficiently close to $V_n$ that during the remainder of the programming interval it will became equal to, or nearly equal to, $V_n$.

Figure 2B:
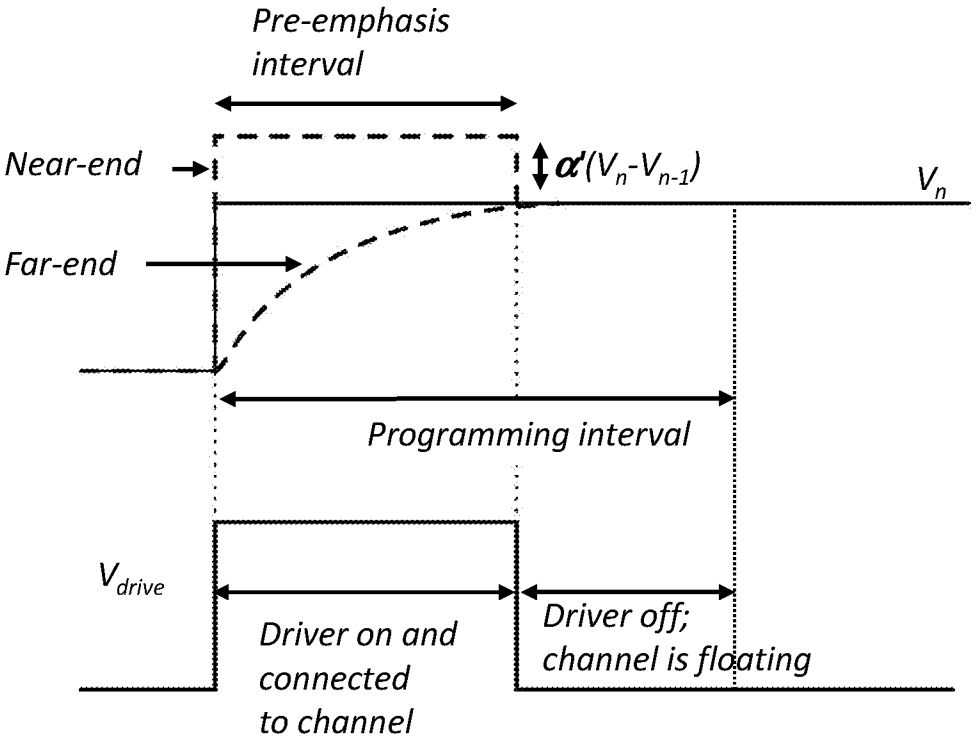
FIG. 2B is a drive waveform diagram, according to an embodiment of the present disclosure.

Referring to FIG. 2B, in some embodiments, instead of the output voltage of the drive circuit 105 being set to $V_n$ at the end of the pre-emphasis interval, the output voltage of the drive circuit 105 disconnected from the transmitting circuit 110. For example, at the end of the pre-emphasis interval, the drive circuit 105 may be switched to a high-impedance state, in which the drive circuit 105 has a high output impedance (e.g., an output impedance between 30 ohms and 100 kiloohms, e.g., greater than 100 ohms) and, as a result, the input end (i.e., the near end) of the transmitting circuit 110 is floating. In such an embodiment, a modified pre-emphasis factor α' may be used to calculate the voltage to be produced during the pre-emphasis interval. During the pre-emphasis interval the voltage on the pixel capacitor 125 changes more rapidly than it would in the embodiment of FIG. 2A, and during the remainder of the programming interval the voltage on the pixel capacitor 125 may continue to change, as the charge delivered to the transmitting circuit 110 during the pre-emphasis interval redistributes itself toward an equilibrium state in which the voltages on the capacitors 140 (i.e., along the length of the conductive trace) and on the pixel capacitor 125 are all the same. The modified pre-emphasis factor α' may be selected so that at the end of the programming interval, the voltage on the pixel capacitor 125 is equal to, or nearly equal to, $V_n$.

In some embodiments the duration of the pre-emphasis interval is between 0.1 and 10.0 microseconds, e.g., 0.6 microseconds or 0.7 microseconds, and the interval between successive pre-emphasis intervals is between 2.0 and 8.0 microseconds. It may be advantageous to use a pre-emphasis interval that is as short as possible, to reduce power consumption. A larger modified pre-emphasis factor α' may correspond to a shorter pre-emphasis interval, however, and the maximum voltage available may be limited to the power supply voltage, which may limit the maximum achievable modified pre-emphasis factor α'.

Figure 3B:
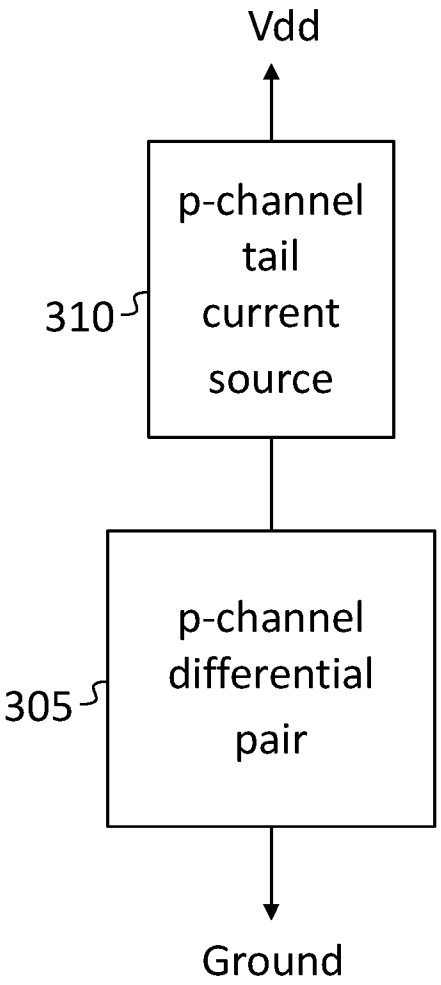
FIG. 3B is a block diagram of an amplifier circuit, according to an embodiment of the present disclosure.
Figure 3A:
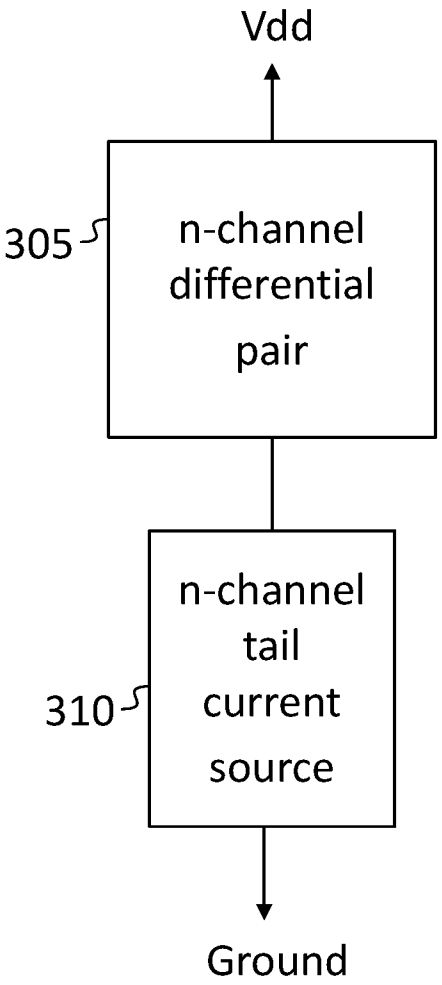
FIG. 3A is a block diagram of an amplifier circuit, according to an embodiment of the present disclosure.

As mentioned above, the drive circuit 105 may operate in either of two states, a first state in which the drive circuit 105 produces a voltage at its output and has a relatively low output impedance (e.g., between 0.1 ohms and 100.0 ohms) and a second state in which the drive circuit 105 is disconnected or shut off and has a relatively high output impedance, as mentioned above. It may operate in the first state during a first interval of time (e.g., during the pre-emphasis interval) and in the second state during a second interval of time which may begin immediately after the end of the pre-emphasis interval, i.e., at the end of the first interval of time. In some embodiments, the drive circuit 105 is connected to the transmitting circuit 110 by a switch 108, as shown in FIG. 1. The switch may include (e.g., consist of) two field effect transistors (FETs) of opposite channel type, connected in parallel (e.g., a p-channel FET connected in parallel with an n-channel FET); both FETs may be turned on in the first state and turned off in the second state. In other embodiments, the drive circuit 105 includes an amplifier, or equivalently, an amplifying stage of a multi-stage amplifier, or a portion of an amplifier other than an amplifying stage (e.g., one arm of a differential pair) that may be (partially or fully) shut off in the second state. For example, referring to FIGS. 3A and 3B, a final amplifying stage of the driver circuit 107 may include a differential pair 305 with a tail current source 310 the gate voltage of which may be set, (i) in the first state, to source or sink an operating tail current, and (ii) in the second state, to be shut off (e.g., by connecting the gate to ground if the tail current source 310 is an n-channel FET and by connecting the gate to Vdd if the tail current source 310 is a p-channel FET). In some embodiments a differential pair may be shut off by shutting off transistors, in the differential pair 305, acting as drain impedances, in addition to, or instead of, shutting off the tail current source. In some embodiments, only the final amplifier stage of the driver circuit 107 is shut off in the second state; in other embodiments one or more amplifier stages preceding the final amplifier stage of the driver circuit 107 are shut off in the second state, instead of, or in addition to, the shutting off of the final amplifier stage of the driver circuit 107.

In some embodiments the voltage at the output of the drive circuit 105 (i.e., at the input end of the transmitting circuit 110) is sensed (e.g., by a sample-and-hold circuit connected to an analog to digital converter) at the end of the interval of time during which the input end of the transmitting circuit 110 is floating. At the end of this interval, the charge in the transmitting circuit 110 has had an opportunity to be redistributed, and therefore the voltage at the input end of the transmitting circuit 110 may be nearly equal to the voltage at the output end (i.e., at the far end) of the transmitting circuit 110. The system (e.g., the drive circuit 105) may then adjust the modified pre-emphasis factor α', to reduce any discrepancy between the sensed voltage and $V_n$.

In some embodiments means for sensing and control of the current driven by the thin-film drive transistor 120, e.g., a system and method for sensing the current driven by the thin-film drive transistor 120 after it has been programmed, and comparing the sensed current to a target current, may be employed. Such a system and method is described, for some embodiments, in the '447 Application '423 Application and the '680 Application. The sensing may be performed by diverting the current driven by the thin-film drive transistor 120 to a current sensing circuit (instead of the light-emitting element) during a sensing interval. Such a system and method may make it possible to compensate (i) for differences between thin-film drive transistors in the display (ii) for changes in transistor characteristics due to aging of the transistors, and (iii) for any errors introduced by incorrect setting of the modified pre-emphasis factor α'. For example, if the measured drive current is lower than the target current, the output voltage during the pre-emphasis interval may be increased, by, e.g., increasing the modified pre-emphasis factor α' or by increasing the voltage $V_n$.

Figure 4:
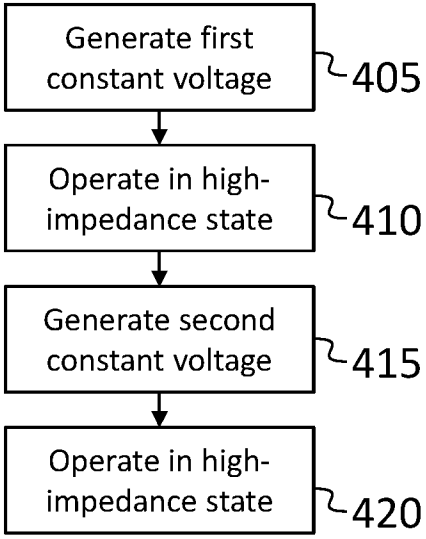
FIG. 4 is a flow chart, according to an embodiment of the present disclosure.

In some embodiments, a method for driving a pixel may include the following, as illustrated in FIG. 4. During a first interval of time, the drive circuit 105 may generate, at 405, a first constant voltage (e.g., the voltage $V_n+\alpha'(V_n-V_{n-1})$). The drive circuit 105 may then operate, during a second time interval, at 410, in a high-impedance state. During a third interval of time, the drive circuit 105 may generate, at 415, a second constant voltage, which may differ from the first constant voltage based (i) on any discrepancy between a sensed current corresponding to the first constant voltage and a target current corresponding to the first constant voltage, and (ii) on any change in V since the first time interval. The drive circuit 105 may then operate, during a fourth time interval, at 420, in a high-impedance state.

In some embodiments, because the input end of the transmitting circuit 110 is floating after the pre-emphasis interval (during which charge injection occurs), faster settling for all pixels (those near the drive circuit 105 and those far from the drive circuit 105), due to charge redistribution in the transmitting circuit 110, may occur. This may result in reduced voltage error between near and far pixels when compared to other pre-emphasis systems in which the pre-emphasis factor may be set for the worst condition, and applied to all pixels in a column driven by the same driver, and in which the near end pixels may take longer to settle since for these pixels there may be a large overshoot just after the beginning of the programming interval due to the pre-emphasis.

In some embodiments a processing circuit may perform some or all of the calculations described herein, e.g., it may calculate the voltage to be produced by the drive circuit 105 during the pre-emphasis interval. The term "processing circuit" is used herein to mean any combination of hardware, firmware, and software, employed to process data or digital signals. Processing circuit hardware may include, for example, application specific integrated circuits (ASICs), general purpose or special purpose central processing units (CPUs), digital signal processors (DSPs), graphics processing units (GPUs), and programmable logic devices such as field programmable gate arrays (FPGAs). In a processing circuit, as used herein, each function is performed either by hardware configured, i.e., hard-wired, to perform that function, or by more general-purpose hardware, such as a CPU, configured to execute instructions stored in a non-transitory storage medium. A processing circuit may be fabricated on a single printed circuit board (PCB) or distributed over several interconnected PCBs. A processing circuit may contain other processing circuits; for example, a processing circuit may include two processing circuits, an FPGA and a CPU, interconnected on a PCB.

As used herein, the term "or" should be interpreted as "and/or", such that, for example, "A or B" means any one of "A" or "B" or "A and B". As used herein, when a method (e.g., an adjustment) or a first quantity (e.g., a first term or a first factor) is referred to as being "based on" a second quantity (e.g., a second term or a second factor) it means that the second quantity is an input to the method or influences the first quantity, e.g., the second quantity may be an input (e.g., the only input, or one of several inputs) to a function that calculates the first quantity, or the first quantity may be equal to the second quantity, or the first quantity may be the same as (e.g., stored at the same location or locations in memory) as the second quantity.

It will be understood that, although the terms "first", "second", "third", etc., may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, a first element, component, region, layer or section discussed herein could be termed a second element, component, region, layer or section, without departing from the spirit and scope of the inventive concept.

Spatially relative terms, such as "beneath", "below", "lower", "under", "above", "upper" and the like, may be used herein for ease of description to describe one element or feature's relationship to another element(s) or feature(s) as illustrated in the figures. It will be understood that such spatially relative terms are intended to encompass different orientations of the device in use or in operation, in addition to the orientation depicted in the figures. For example, if the device in the figures is turned over, elements described as "below" or "beneath" or "under" other elements or features would then be oriented "above" the other elements or features. Thus, the example terms "below" and "under" can encompass both an orientation of above and below. The device may be otherwise oriented (e.g., rotated 90 degrees or at other orientations) and the spatially relative descriptors used herein should be interpreted accordingly. In addition, it will also be understood that when a layer is referred to as being "between" two layers, it can be the only layer between the two layers, or one or more intervening layers may also be present.

The terminology used herein is for the purpose of describing particular embodiments only and is not intended to be limiting of the inventive concept. As used herein, the terms "substantially," "about," and similar terms are used as terms of approximation and not as terms of degree, and are intended to account for the inherent deviations in measured or calculated values that would be recognized by those of ordinary skill in the art.

As used herein, the singular forms "a" and "an" are intended to include the plural forms as well, unless the context clearly indicates otherwise. It will be further understood that the terms "comprises" and/or "comprising", when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. Expressions such as "at least one of," when preceding a list of elements, modify the entire list of elements and do not modify the individual elements of the list. Further, the use of "may" when describing embodiments of the inventive concept refers to "one or more embodiments of the present disclosure". Also, the term "exemplary" is intended to refer to an example or illustration. As used herein, the terms "use," "using," and "used" may be considered synonymous with the terms "utilize," "utilizing," and "utilized," respectively.

It will be understood that when an element or layer is referred to as being "on", "connected to", "coupled to", or "adjacent to" another element or layer, it may be directly on, connected to, coupled to, or adjacent to the other element or layer, or one or more intervening elements or layers may be present. In contrast, when an element or layer is referred to as being "directly on", "directly connected to", "directly coupled to", or "immediately adjacent to" another element or layer, there are no intervening elements or layers present.

Any numerical range recited herein is intended to include all sub-ranges of the same numerical precision subsumed within the recited range. For example, a range of "1.0 to 10.0" or "between 1.0 and 10.0" is intended to include all subranges between (and including) the recited minimum value of 1.0 and the recited maximum value of 10.0, that is, having a minimum value equal to or greater than 1.0 and a maximum value equal to or less than 10.0, such as, for example, 2.4 to 7.6. Any maximum numerical limitation recited herein is intended to include all lower numerical limitations subsumed therein and any minimum numerical limitation recited in this specification is intended to include all higher numerical limitations subsumed therein.

Although exemplary embodiments of a system and method for driving a pixel have been specifically described and illustrated herein, many modifications and variations will be apparent to those skilled in the art. Accordingly, it is to be understood that a system and method for driving a pixel constructed according to principles of this disclosure may be embodied other than as specifically described herein. The invention is also defined in the following claims, and equivalents thereof.

What is claimed is:

1. A circuit, comprising:

a drive circuit having an output and comprising:

a pre-emphasis circuit; and an output stage connected to an output of the pre-emphasis circuit, the pre-emphasis circuit being configured to generate, during a first interval of time, a pre-emphasized signal, the output stage being configured to produce, at the output of the drive circuit, a constant signal based on the pre-emphasized signal during the first interval of time, and to disconnect the pre-emphasis circuit from the output of the drive circuit during a second interval of time, the second interval of time beginning at the end of the first interval of time, wherein the drive circuit has a first output impedance during the first interval of time, and a second output impedance that is greater than the first output impedance during the second interval of time.

2. The circuit of claim 1, further comprising:

a driven circuit, and a transmitting circuit, connecting the output of the drive circuit to the driven circuit, the transmitting circuit comprising a circuit equivalent to a resistor-capacitor low-pass circuit.

3. The circuit of claim 2, wherein the driven circuit comprises a pixel circuit for a pixel of a display.

4. The circuit of claim 3, wherein the transmitting circuit is connected to a gate of a thin-film drive transistor of the pixel circuit.

5. The circuit of claim 4, wherein the output stage comprises an amplifier stage configured, in a first state, to produce an output voltage and, in a second state, to have an output impedance greater than 100 ohms.

6. The circuit of claim 5, wherein the amplifier stage comprises:

a differential pair; and a tail current source connected to the differential pair, wherein, in the second state, the tail current source is shut off.

7. The circuit of claim 6, wherein the tail current source is an n-channel metal oxide transistor, and, in the second state, a gate of the tail current source is connected to ground.

8. The circuit of claim 5, wherein the output stage comprises a plurality of differential pairs, and a corresponding plurality of tail current sources, each connected to a respective one of the differential pairs, wherein, in the second state, each of the tail current sources is shut off.

9. The circuit of claim 8, further comprising a sensing and control circuit configured to sense a drive current driven by the thin-film drive transistor, and to control the pre-emphasized signal based on a difference between the sensed drive current and a target drive current.

10. The circuit of claim 1, wherein the output stage comprises an amplifier stage configured, in a first state, to produce an output voltage and, in a second state, to have an output impedance greater than 100 ohms.

11. The circuit of claim 10, wherein the amplifier stage comprises:

a differential pair; and a tail current source connected to the differential pair, wherein, in the second state, the tail current source is shut off.

12. The circuit of claim 11, wherein the tail current source is an n-channel metal oxide transistor, and, in the second state, a gate of the tail current source is connected to ground.

13. The circuit of claim 10, wherein the output stage comprises a plurality of differential pairs, and a corresponding plurality of tail current sources, each connected to a respective one of the differential pairs, wherein, in the second state, each of the tail current sources is shut off.

14. The circuit of claim 10, wherein the driven circuit comprises a pixel circuit for a pixel of a display.

15. The circuit of claim 14, wherein the drive circuit is connected to a gate of a thin-film drive transistor of the pixel circuit.

16. The circuit of claim 15, further comprising a sensing and control circuit configured:

to sense:

a drive current driven by the thin-film drive transistor, or a voltage at the output of the drive circuit during the second interval of time; and to control the pre-emphasized signal based on:

a difference between the sensed drive current and a target drive current, or a difference between the sensed voltage and a target voltage.

17. A method for driving a pixel in a display, the method comprising:

during a first interval of time, generating, by a drive circuit having an output, a first constant pre-emphasized output voltage; and during a second interval of time, beginning at the end of the first interval of time, causing the drive circuit to have a high output impedance at the output of the drive circuit, wherein an output impedance of the drive circuit during the first interval of time is lower than the high output impedance of the drive circuit during the second interval of time.

18. The method of claim 17, further comprising sensing a drive current driven by a thin-film drive transistor of a pixel circuit of a display, and during a third interval of time following the second interval of time, generating, by the drive circuit, a second constant pre-emphasized output voltage, the second constant pre-emphasized output voltage being based on the sensed a drive current.

19. The method of claim 17, comprising, at the end of the first interval of time, switching off a transistor connected to the output of the drive circuit.

20. A display, comprising:

a pixel circuit, a drive circuit having an output connected to the pixel circuit; and means for sensing and control, the drive circuit comprising:

a pre-emphasis circuit; and an output stage connected to an output of the pre-emphasis circuit, the pre-emphasis circuit being configured to generate, during a first interval of time, a pre-emphasized signal, the output stage being configured:

to produce, at the output of the drive circuit, a constant signal based on the pre-emphasized signal during the first interval of time, and to disconnect the pre-emphasis circuit from the output of the drive circuit during a second interval of time, the second interval of time beginning at the end of the first interval of time, the means for sensing and control being configured:

to sense a drive current driven by a thin-film drive transistor of the pixel circuit, and to control the pre-emphasized signal based on a difference between the sensed drive current and a target drive current, wherein the drive circuit has a first output impedance during the first interval of time, and a second output impedance that is greater than the first output impedance during the second interval of time.

* * * * *